United States Patent [19]

Tobey

[11] 4,368,864

[45] Jan. 18, 1983

[54] ISOLATING FOOT PAD OR MOUNT

[75] Inventor: Richard D. Tobey, Beavercreek, Ohio

[73] Assignee: Tech Products Corporation, Dayton, Ohio

[21] Appl. No.: 190,349

[22] Filed: Sep. 24, 1980

[51] Int. Cl.[3] ..... A47B 91/00

[52] U.S. Cl. ..... 248/188.9; 248/615; 248/677

[58] Field of Search ..... 248/188.4, 188.3, 188.9, 248/188.8, 188.1, 188.3, 615, 677, 650, 649

[56] References Cited

U.S. PATENT DOCUMENTS

| | | | |
|---|---|---|---|
| 1,245,243 | 11/1917 | Lapham . | |
| 1,638,725 | 8/1927 | Chesnutt | 248/188.9 X |
| 1,814,334 | 7/1931 | Potigian | 248/188.9 |
| 2,666,608 | 1/1954 | Holm | 248/188.8 X |
| 2,728,166 | 12/1955 | Molla | 248/188.9 |
| 2,739,774 | 3/1956 | Crede . | |
| 2,921,760 | 1/1960 | Wheeler . | |
| 2,942,829 | 6/1960 | Stiffel | 248/188.3 |
| 3,601,345 | 8/1971 | Johnson . | |
| 3,717,318 | 2/1973 | Yamasita . | |
| 3,815,852 | 6/1974 | May . | |

FOREIGN PATENT DOCUMENTS

| | | | |
|---|---|---|---|
| 576567 | 3/1958 | Italy | 248/188.3 |

*Primary Examiner*—J. Franklin Foss

*Attorney, Agent, or Firm*—Jacox & Meckstroth

[57] ABSTRACT

Vibration isolation support structure for supporting an object upon a floor or the like. The structure includes a housing in which the lower portion thereof is adapted to engage a floor. The portion of the housing which engages the floor consists of elastomeric material. The housing has an opening therein at the upper portion thereof. Within the housing is a dish-shaped receptacle. A stem extends freely through the opening in the housing and has a base which rests upon the dish-shaped receptacle. The stem is adapted to support a load. The base and the stem are angularly and laterally movable with respect to the dish-shaped receptacle. Therefore, an object supported by the stem is laterally and angularly movable with respect to the housing. Thus, even though a floor upon which the housing rests is uneven in nature, the load supported by the support structure may assume a level position.

3 Claims, 7 Drawing Figures

40
26
8
24
30
10

26
34
24
30
14
8
10
14a
24a 26
34
24
30
14
8
10
24a
14a 26
8
30
34
24
14
10
24a
14a 56
54
58
52
50
54a
52a 66
64
68
62
60
62a 76
74
78
72
70
72a

ISOLATING FOOT PAD OR MOUNT

BACKGROUND OF THE INVENTION

Numerous types of foot pads or mounts have been created to serve as support members at the lower ends of legs of machines, other equipment, tables, furniture, and the like.

It is an object of this invention to provide an isolating foot pad or mount which permits elevational, angular, and lateral adjustment or movement of a supported object with respect to the foot pad.

Another object of this invention is to provide such an isolating foot pad or mount which can be sturdily and ruggedly constructed to support heavy loads while remaining relatively small in physical dimensions.

It is another object of this invention to provide such an isolating foot pad or mount which can be constructed at relatively low costs.

Other objects and advantages of the isolating foot pad or mount of this invention reside in the construction of parts, the combination thereof, the method of production and the mode of operation, as will become more apparent from the following description.

DETAILED DESCRIPTION OF THE INVENTION

Figures 1, 2, 3, 4, 5, 6, 7:
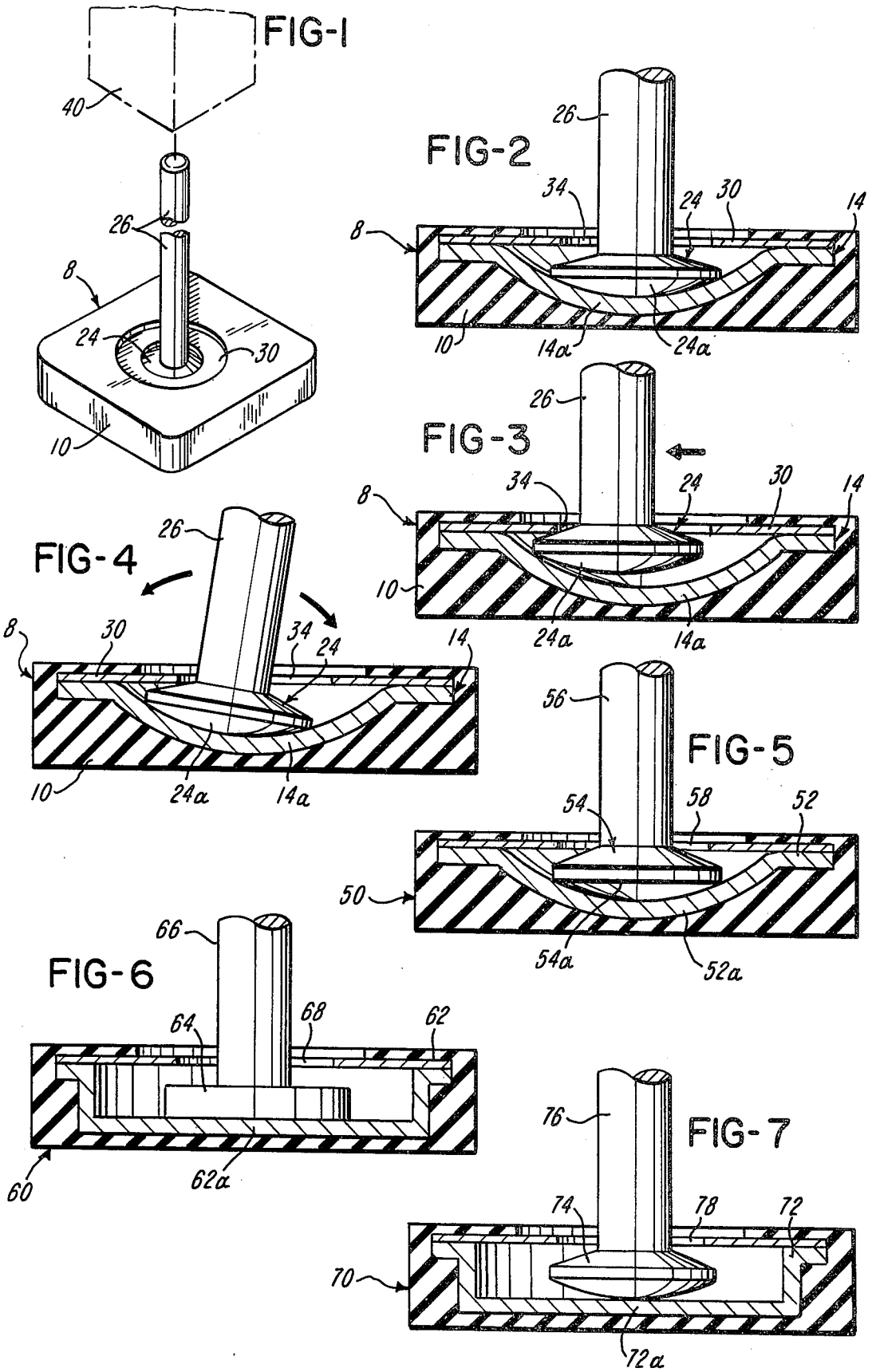
FIG. 1 is a perspective diagrammatic view of an isolating foot pad or mount of this invention, illustrating attachment thereof to a leg for support thereof.
FIG. 2 is an enlarged sectional view illustrating an isolating foot pad or mount of this invention.
FIG. 3 is a sectional view drawn on substantially the same scale as FIG. 2, of the isolating foot pad or mount shown in FIG. 2, with a portion thereof in a position of adjustment.
FIG. 4 is a sectional view, drawn on substantially the same scale as FIGS. 2 and 3, showing a portion of the isolating foot pad or mount in another position of adjustment.
FIG. 5 is a sectional view, drawn on substantially the same scale as FIGS. 2, 3, and 4, showing another embodiment of the isolating foot pad or mount of this invention.
FIG. 6 is a sectional view, drawn on substantially the same scale as FIGS. 2, 3, 4, and 5, showing another embodiment of the isolating foot pad or mount of this invention.
FIG. 7 is a sectional view, drawn on substantially the same scale as FIGS. 2, 3, 4, 5, and 6, showing another embodiment of the isolating foot pad or mount of this invention.

An isolating foot pad or mount 8 of this invention as illustrated in FIGS. 1, 2, 3, and 4 comprises a housing 10 of any suitable elastomeric material. Within the housing 10 is a receptacle 14 of rigid material, such as metal or the like, having an arcuate or dished portion 14*a*. Resting upon the arcuate or dished portion 14*a* of the receptacle 14 is a base 24 of a stem 26. The base 24 has an arcuate bottom surface 24*a*, which may be a segment of a spherical surface. The bottom surface 24*a* is shown as having substantially the same curvature as the curvature of the dished portion 14*a* of the receptacle 14.

A rigid cover member 30 partially encloses the housing 10 and has a relatively large opening 34 therein, through which the stem 26 freely extends. The rigid cover member 30 may be of any suitable material, such as metal or the like. The elastomeric material of the housing 10 is shown partially enclosing the cover member 30.

The stem 26 is attachable by any suitable means, not shown, to a suitable leg 40 for support of a machine tool, or item of furniture, table or the like, as illustrated in FIG. 1. If the floor, not shown, upon which the housing 10 rests is substantially level and if all other related conditions are normal, the position of the stem 26 and base 24 thereof may be substantially as illustrated in FIG. 2.

If it is necessary to position the housing 10 in engagement with a vertical wall, it may be necessary for the stem 26 to move laterally with respect to the housing 10, to a position substantially as shown in FIG. 3, in order to accommodate a supported machine or the like. In this position, the base 24 is supported upon a part of the dished portion 14*a* which is spaced from the center of the dished portion 14*a*.

In the event that the mount 8 of this invention must rest upon a floor or other surface which is uneven, the stem 26 may be angular with respect to the housing 10, as illustrated in FIG. 4. In this position the bottom surface 24*a* of the base 24 is supported upon a part of the dished portion 14*a* of the receptable 14 which is spaced from the center of the dished portion 14*a*.

Thus, it is understood that the stem 26 is laterally, angularly, and elevationally movable with respect to the housing 10.

Thus, if one or more of various types of conditions exist, such as limited space requirements, a floor which is not level, or the like, the isolating foot pad or mount 8 of this invention is capable of accommodation of the conditions to permit firm and level insulated support of a machine, or other equipment, or piece of furniture, or the like.

An isolating mount or foot pad of this invention may be molded as a unit or otherwise constructed.

FIG. 5 shows another embodiment of an isolating foot pad or mount of this invention. A housing 50 of elastomeric material has a receptacle 52 therein. The receptacle 52 is similar to the receptacle 14 and has an arcuate or dished portion 52*a*. Resting upon the dished portion 52*a* is a base 54 of a stem 56. The base 54 has a substantially flat bottom surface 54*a*. The housing 50 has a relatively large opening 58 at the upper portion thereof, through which the stem 56 freely extends. Thus, the stem 56 is freely angularly, laterally, and elevationally movable with respect to the housing 50.

FIG. 6 illustrates another embodiment of an isolating foot pad or mount of this invention. A housing 60 of elastomeric material has therewithin a receptacle 62 which has a substantially flat dish portion 62*a*. Resting upon the dish portion 62*a* is a base 64 of a stem 66. The base 64 has a substantially flat bottom surface. The housing 60 has a relatively large opening 68 at the upper portion thereof, through which the stem 66 extends. Thus, the stem 66 is laterally and angularly movable with respect to the housing 60.

FIG. 7 shows another embodiment of the isolating foot pad or mount of this invention. A housing 70 encloses a receptacle 72 having a dish portion 72*a*. Resting upon the dish portion 72*a* is a base 74 of a stem 76. The dish portion 72*a* is substantially flat. The base 74 has a bottom surface 74*a* which is arcuate or a segment of a sphere. The housing 70 has a relatively large opening 78 at the upper portion thereof, through which the stem 76 extends. Thus, the stem 76 is laterally and angularly movable with respect to the housing 70.

Although the preferred embodiment of the isolating foot pad or mount of this invention has been described, it will be understood that within the purview of this invention various changes may be made in the form, details, proportion and arrangement of parts, the combination thereof, and the mode of operation, which generally stated consist in a structure within the scope of the appended claims.

The invention having thus been described, the following is claimed:

1. A mount unit for support of a piece of equipment or furniture or the like upon a floor comprising:

a housing having a lower portion adapted to rest upon a floor, the lower portion of the housing being of elastomeric material, the housing having an upper portion provided with an opening therein, the opening having a given area, support means forming an arcuate concave support surface within the housing the support means resting upon the elastomeric material, a stem extending through the opening in the upper portion of the housing, the stem having a cross-sectional area at the opening which is considerably less than the given area of the opening, the stem being adapted to support a piece of equipment or furniture or the like, a base joined to the stem within the housing and having an arcuate convex surface resting upon the arcuate concave support surface, the arcuate convex surface having a curvature which is complementary to the curvature of the arcuate concave support surface, the area of the arcuate concave support surface being considerably greater than the area of the arcuate convex surface of the base, the stem thus being laterally and angularly movable within the opening in the housing as the stem supports a piece of equipment or furniture or the like, the base thus being laterally and angularly movable with respect to the support surface, so that as the housing rests upon a floor the base and the stem may assume any one of a multiplicity of positions with respect to the housing and the housing may assume any one of a multiplicity of angles with respect to the piece of equipment or furniture or the like.

2. A mounting unit for support of a piece of equipment or furniture or the like upon a floor comprising:

a housing provided with an opening in the upper portion thereof, the opening having a given area, the housing having a lower portion adapted to rest upon a floor, the lower portion of the housing being of elastomeric material, a receptacle within the housing, and resting upon the lower portion of the housing, the receptacle having a concave arcuate support surface of a given area, a stem extending into the housing through the opening, the stem having a cross-sectional area at the opening which is considerably smaller than the area of the opening so that the stem is laterally and angularly movable within the opening, a base at the lower portion of the stem, the base having a convex arcuate surface in engagement with the concave arcuate support surface of the receptacle, the area of the convex arcuate surface of the base being considerably less than the given area of the concave arcuate support surface of the receptacle, the base thus being laterally and angularly movable with respect to the housing as the base moves laterally and angularly upon the support surface and as the stem moves angularly and laterally within the opening in the housing, the stem being adapted to support a piece of equipment or furniture as the housing rests upon a floor.

3. The mount of claim 2 in which the convex arcuate surface and the concave arcuate surface are complementary and represent segments of a spherical surface.

* * * * *

UNITED STATES PATENT AND TRADEMARK OFFICE

CERTIFICATE OF CORRECTION

PATENT NO. : 4,368,864

DATED : January 18, 1983

INVENTOR(S) : Richard D. Tobey

It is certified that error appears in the above-identified patent and that said Letters Patent are hereby corrected as shown below:

Column 4, line 13, after "portion" insert ---which is---.

Signed and Sealed this

*Seventeenth* Day of *May 1983*

[SEAL]

*Attest:*

DONALD J. QUIGG

*Attesting Officer*

*Acting Commissioner of Patents and Trademarks*